US006759638B2

(12) United States Patent
Han et al.

(10) Patent No.: US 6,759,638 B2
(45) Date of Patent: Jul. 6, 2004

(54) MICROWAVE OVEN HAVING A PROJECTING DOOR AND COOKING CAVITY

(75) Inventors: Dae-Sung Han, Hwasung (KR); Yong-Woon Han, Kunpo (KR); Han-Seong Kang, Suwon (KR); Joo-Yong Yeo, Suwon (KR); Seong-Deog Jang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/323,740

(22) Filed: Dec. 20, 2002

(65) Prior Publication Data

US 2004/0031792 A1 Feb. 19, 2004

Related U.S. Application Data

(60) Provisional application No. 60/403,411, filed on Aug. 13, 2002.

(51) Int. Cl.[7] ..... H05B 6/76

(52) U.S. Cl. ..... 219/739; 219/740; 219/756; 124/35 R

(58) Field of Search ..... 219/756, 757, 219/739, 740, 741, 742; 174/35 R, 35 GC; 126/190, 198, 21 A

(56) References Cited

U.S. PATENT DOCUMENTS

| | | | | | |
|---|---|---|---|---|---|
| 3,594,531 | A | * | 7/1971 | Hough | 219/740 |
| 3,943,318 | A | * | 3/1976 | Hirai | 219/740 |
| 4,645,892 | A | * | 2/1987 | Gustafsson | 219/742 |
| 4,794,218 | A | * | 12/1988 | Nakano et al. | 219/743 |
| 5,365,918 | A | | 11/1994 | Smith et al. | 126/21 A |

FOREIGN PATENT DOCUMENTS

| | | | | |
|---|---|---|---|---|
| JP | 1-184332 | * | 7/1989 | 219/740 |

OTHER PUBLICATIONS

U.S. patent application Ser. No. 10/323,739, Dae–Sung Han et al., filed Dec. 20, 2002.
U.S. patent application Ser. No. 10/324,057, Dae–Sung Han et al., filed Dec. 20, 2002.

* cited by examiner

*Primary Examiner*—Philip H. Leung
(74) *Attorney, Agent, or Firm*—Staas & Halsey LLP

(57) ABSTRACT

A microwave oven includes a cooking chamber having an opening and a door which selectively opens and closes the opening of the cooking chamber. The door includes a frame which is constructed to form a circumferential edge of the door and be brought into contact with a rim of the opening, and a front plate which is projected forward from both sides of the frame. The door is formed by joining a first piece including the frame with a second piece including the front plate.

19 Claims, 7 Drawing Sheets

MICROWAVE OVEN HAVING A PROJECTING DOOR AND COOKING CAVITY

CROSS-REFERENCE TO RELATED APPLICATIONS

This application claims the benefit of Patent Application No. 60/403,411 filed on Aug. 13, 2002, in the United States Patent Office, the disclosure of which is incorporated herein by reference.

BACKGROUND OF THE INVENTION

1. Field of the Invention

The present invention relates to a microwave oven, and more particularly, to a microwave oven having a door which is projected forward to allow a user to observe a cooking chamber from various locations and constructed to be easily manufactured.

2. Description of the Related Art

Generally, a microwave oven is an appliance that cooks or heats food laid in a cooking chamber using microwaves that are generated by a magnetron disposed in a machine room. The microwave oven cooks or heats the food using a frictional heat produced between moisture molecules of the food, and generated by irradiating the microwaves into the cooking chamber. That is, the microwaves repeatedly change the molecular arrangement of moisture contained in the food to cook the food.

FIG. 1 shows a perspective view of a conventional microwave oven with its door 8 opened. As shown in FIG. 1, the microwave oven comprises a housing 1 having a machine room 2 and a cooking chamber 3 partitioned from each other in an interior of the housing 1. A magnetron 4 which generates microwaves, and a blower fan 5 which cools the magnetron 4 and discharges moisture and odor generated from food to the outside of the microwave oven are mounted in the machine room 2. The blower fan 5 discharges the moisture and odor by circulating air through the cooking chamber 3.

The cooking chamber 3 is constructed in a form of a box with its front opened. The cooking chamber 3 has a rectangular bottom 3*a*, a front end of which is laid on the same plane as a front of the cooking chamber 3. A turntable 6 which allows the food to be laid thereon, and a rotation guide (not shown) which rotatably supports the turntable 6 are mounted on the rectangular bottom 3*a*. The turntable 6 is rotated at a relatively low speed while being coupled to a motor (not shown) disposed under the cooking chamber 3.

The door 8 is rotatably hinged to one side of the housing 1 in front of the cooking chamber 3 so as to selectively open and close the cooking chamber 3. The door 8 is constructed in a form of a rectangle. A see-through member 9 having a plurality of see-through holes is fitted into a center portion of the door 8 to allow a user to see through the door 8. The door 8, including the see-through member 9, has planar front and back surfaces. Accordingly, where the door 8 is tightly closed, the planar back surface of the door 8 comes into close contact with the front of the cooking chamber 3, and the front of the door 8 constitutes a plane.

Where the microwave oven operates, the microwaves generated by the magnetron 4 are irradiated into the cooking chamber 3, and simultaneously, the turntable 6 is rotated at a relatively low speed. Accordingly, the food laid on the turntable 6 is cooked by the irradiated microwaves.

However, since the conventional microwave oven having the construction as described above is shaped in a form of a hexahedron and the see-through member 9 formed to allow a user to see through the door 8 constitutes a plane along with the frame of the door 8, the user has to observe the interior of the cooking chamber 3 with his eyes being level with the see-through member 9. That is, the user must adjust his/her body toward and directly in front of the see-through member 9 to ascertain a cooking status of the food.

Specifically, the door 8 of the conventional microwave oven and the see-through member 9 thereof are planar, and a region where the see-through holes are formed is small as compared to the overall size of the door 8. Therefore, the user has to approach the see-thorough member 9 to observe the interior of the cooking chamber 3. As a result, the conventional microwave oven is inconvenient and time-consuming for the user to ascertain the cooking status of the food being cooked in the cooking chamber 3. Therefore, the user cannot carry out other tasks and must remain attentive to the microwave oven while cooking the food with the conventional microwave oven.

SUMMARY OF THE INVENTION

Accordingly, it is an aspect of the present invention to provide a microwave oven which allows a cooking status of food being cooked in a cooking chamber to be easily and rapidly ascertained from various locations.

Another aspect of the present invention is to provide a microwave oven having a door which enables a user to observe the interior of a cooking chamber from various locations, and is constructed to be easily manufactured.

Additional aspects and advantages of the invention will be set forth in part in the description which follows and, in part, will be obvious from the description, or may be learned by practice of the invention.

To achieve the above and/or other aspects of the present invention, there is provided a microwave oven comprising a heating unit to cook food, a cooking chamber having an opening, and a door which selectively opens and closes the opening of the cooking chamber. The door comprises a first piece including a frame which is constructed to form an outer edge of the door and be brought into contact with a rim of the opening, and a second piece including a front plate which is projected forward from both sides of the frame, wherein the door is formed by joining the first piece with the second piece.

The first piece may further include top and bottom plates, and the top and bottom plates are attached to respective upper and lower ends of the front plate to form a cooking space extending from the cooking chamber, together with the front plate.

The front, top and bottom plates may be made of metallic plates, and the front and top plates-include a plurality of see-through holes.

The heating unit may include a magnetron which generates microwaves to cook the food, and the frame may include a plurality of choke slits which prevent a leakage of the microwaves from the cooking chamber through the door, where the opening is closed by the door.

The front plate may have a half-cylinder shape, and the top and bottom plates may each be shaped in a form of a semi-circle to cover a top and a bottom of an inner space formed inside the front plate, respectively.

The front plate may have a half-box shape with an open top and bottom, and the top and bottom plates may each be shaped in a form of a rectangle to cover a top and a bottom of an inner space formed inside the front plate, respectively.

The top and bottom plates may be attached to the respective upper and lower ends of the front plate through one of a welding process, a caulking process and a riveting process.

The front plate may include flange portions which extend outward from respective side ends of the front plate, and the flange portions are attached to corresponding inner ends of the both sides of the frame constituting the first piece.

The flange portions may be attached to the frame through one of a welding process, a caulking process and a riveting process.

The frame may include stepped portions which are provided at the inner ends of the both sides of the frame so as to receive the flange portions of the front plate.

In the microwave oven of the present invention, the first piece may be manufactured by primarily manufacturing a single flat body, into which the frame and the top and bottom plates are integrated, through a press working process, and secondarily bending the top and bottom plates forward at a right angle.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
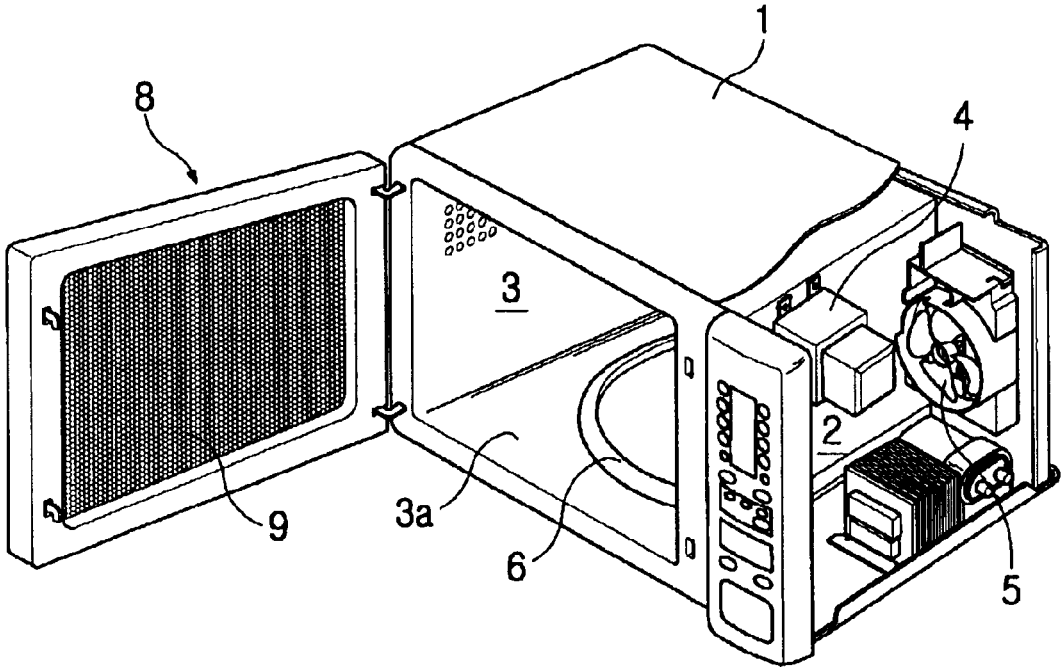
FIG. 1 (PRIOR ART)
FIG. 1 is a perspective view of a conventional microwave oven with its door being opened.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
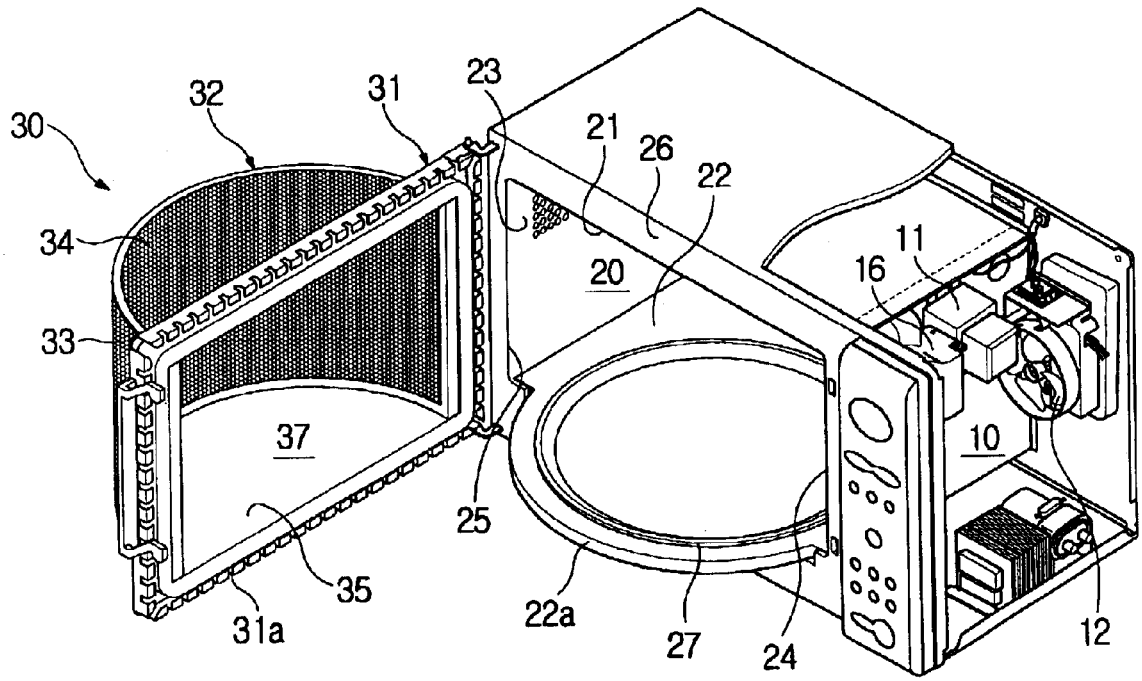
FIG. 2 is a perspective view showing a microwave oven with its door being opened according to an embodiment of the present invention.
Figure 3:
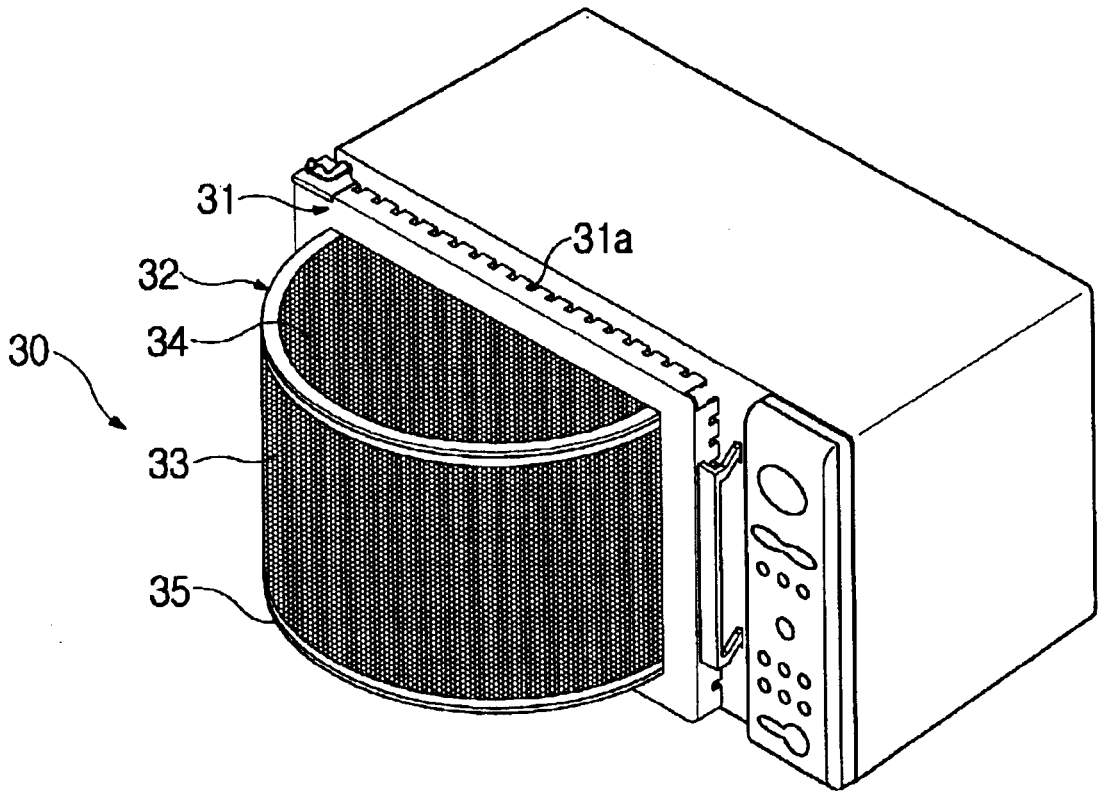
FIG. 3 is a perspective view of the microwave oven shown in FIG. 2 with its door being closed.

FIGS. 2 and 3 show perspective views of a microwave oven according to an embodiment of the present invention, wherein a door 30 is opened in FIG. 2, and closed in FIG. 3.

As shown in FIGS. 2 and 3, the microwave oven comprises a machine room 10 in which various electrical parts are mounted to generate microwaves, a cooking chamber 20 which provides a space to cook food and has an opened front, and the door 30 which selectively opens and closes the cooking chamber 20.

The machine room 10 includes a magnetron 11 which generates the microwaves, and a blower fan 12 which cools the magnetron 11 and discharges moisture and odor generated from the food to the outside of the microwave oven.

The cooking chamber 20 is defined by a top 21, a bottom 22, sidewalls 23 and 24 and a rear wall (not shown). Additionally, the cooking chamber 20 is provided with a front opening 25 to allow the front of the cooking chamber 20 to be opened. The door 30 is rotatably hinged to the front of the cooking chamber 20 so as to selectively open and close the front opening 25. A rectangular rim 26 is formed around the front opening 25 of the cooking chamber 20 so as to tightly close the front opening 25 by coming into close contact with a frame 31 of the door 30 where the door 30 is closed.

A turntable 27 which allows food to be cooked or heated thereon, and a rotation guide (not shown) which rotatably supports the turntable 27 are mounted on the bottom 22 of the cooking chamber 20. The turntable 27 allows food to be effectively cooked by uniformly irradiating the microwaves onto the food while being rotated at a relatively low speed by a motor (not shown) disposed under the bottom 22 of the cooking chamber 20.

The door 30 includes the frame 31 and a see-through member 32. The frame 31 has a rectangular shape so as to prevent a leakage of the microwaves while being in close contact with the rectangular rim 26 that defines the front opening 25 of the cooking chamber 20. The see-through member 32 is fitted into an opening of the frame 31 and allows a user to see through the door 30 so as to ascertain a cooking status of the food in the cooking chamber 20.

A plurality of choke slits 31*a* are formed along an inner edge of the frame 31. The choke slits 31*a* prevent a leakage of the microwaves where the frame 31 is brought into contact with the rectangular rim 26 of the front of the cooking chamber 20.

The see-through member 32 comprises a front plate 33 which is half-cylindrically projected forward, a top plate 34 which is laid on a top of the front plate 33 to cover a top of an inner space formed inside the front plate 33, and a bottom plate 35 laid under the bottom of the front plate 33 to cover a bottom of the inner space.

To allow the half-cylindrically projected see-through member 32 to form a cooking space 37, which communicates with the cooking chamber 20, a front part 22*a* of the bottom 22 of the cooking chamber 20 is semi-circularly projected forward from the cooking chamber 20. Accordingly, where the door 30 closes the cooking chamber 20, the front part 22*a* of the bottom 22 of the cooking chamber 20 is positioned over the bottom plate 35 of the see-through member 32, and an interior of the half-cylindrical see-through member 32 forms the cooking space 37.

A plurality of see-through holes are closely arranged on the front and top plates 33 and 34 of the see-through member 32 to allow a user to see through the door 30. Therefore, the user can observe the interior of the cooking chamber 20 through the front and top plates 33 and 34 of the see-through member 32. That is, with the microwave oven of the present invention, the user can observe the interior of the cooking chamber 30, for example, from the above and both sides of the microwave oven, as well as directly in front of the microwave oven. Accordingly, the user can ascertain the cooking status of food laid in the cooking chamber 20 while carrying out other tasks near the microwave oven.

A transparent panel (not shown) made of a transparent material is attached to an outside surface of the see-through member 32, so as to prevent the interior of the cooking chamber 20 from communicating with the outside of the microwave oven through the see-through holes formed on the see-through member 32, and enable the user to observe the interior of the cooking chamber 20 through the see-through member 32.

Although the see-through holes have been described as not being formed on the bottom plate 35 of the see-through member 32, in consideration of the fact that a microwave oven is generally placed at a position level with or below the eye-level of the user in a cooking space, the see-through holes may be formed on the bottom plate 35 so as to provide further viewing angles to view the interior of the cooking chamber 20.

As shown in FIGS. 2 and 3, the see-through member 32 of the door 30 is projected forward to form a half-cylindrical shape. With such a structure, condensation occurring due to the moisture generated from the food, on the inside surface of the see-through member 32, can be effectively prevented.

Figure 4:
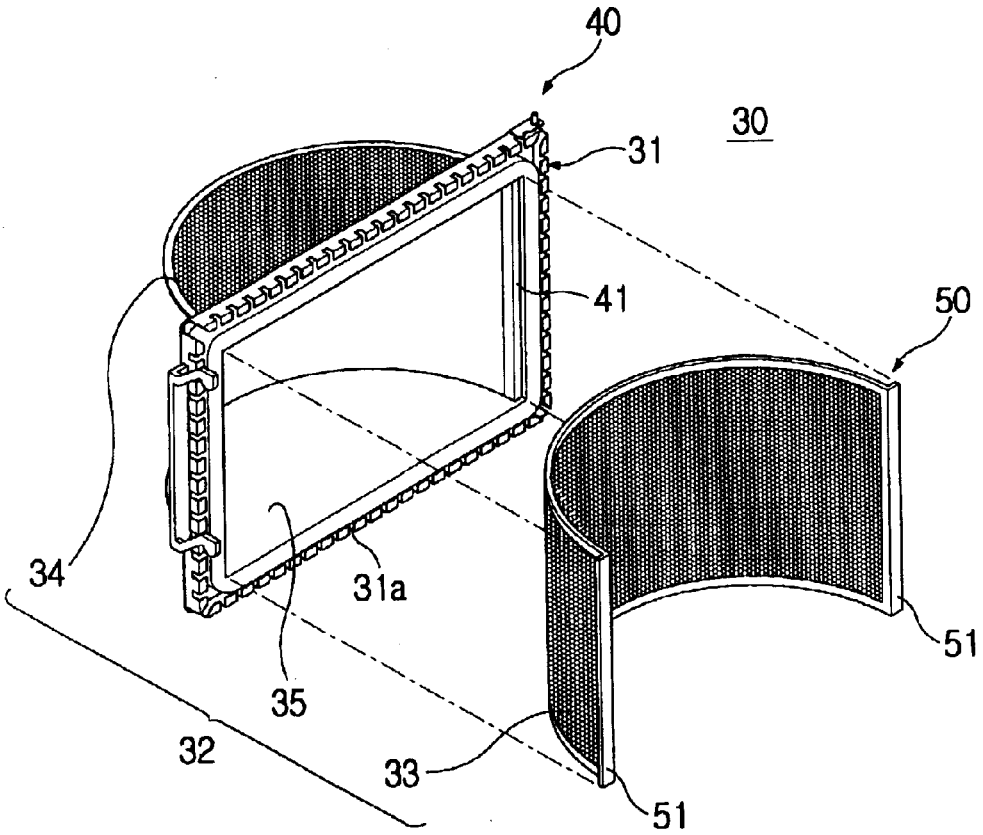
FIG. 4 is an exploded perspective view of the door of the microwave oven shown in FIGS. 2 and 3.
Figure 5:
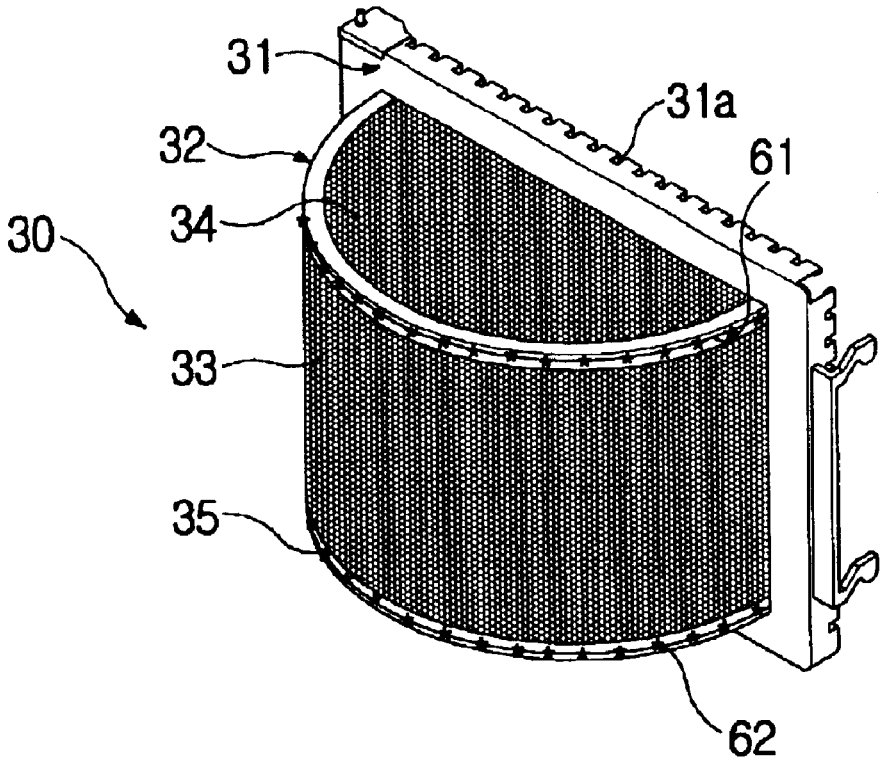
FIG. 5 is a perspective view of the door shown in FIG. 4, as assembled in accordance with the present invention.

FIGS. 4 and 5 show the construction of the door 30 in detail. FIG. 4 shows an exploded perspective view of the door 30 and FIG. 5 shows a perspective view of the assembled door 30.

As shown in these drawings, the door 30 has a simple structure and is formed by joining two pieces made of, for example, metallic plates together. That is, the door 30 comprises first and second pieces 40 and 50. The first piece 40 includes the frame 31 and the top and bottom plates 34 and 35 of the see-through member 32 integrated with the frame 31 at corresponding upper and lower ends of the frame 31. The second piece 50 includes the front plate 33 of the see-through member 32.

The first piece 40 is manufactured by, for example, primarily manufacturing a single flat body, into which the frame 31 and the top and bottom plates 34 and 35 of the see-through member 32 are integrated, through a press working process, and secondarily bending the top and bottom plates 34 and 35 forward at a right angle. Thereafter, the second piece 50, which is manufactured through a press working process to semi-circularly project forward, is joined with the manufactured first piece 40.

An operation of joining the first piece 40 with the second piece 50 is described in detail below. To join the first piece 40 with the second piece 50, two flange portions 51 are extended from corresponding side ends of the front plate 33 at a right angle in outwardly lateral directions. To engage with the two flange portions 51, two stepped portions 41 are formed on an inner end of both sides of the frame 31. The width of each of the stepped portions 41 may be greater than the width of each of the flange portions 51. Both sides of the second piece 50 are secured to the both sides of the first piece 40 by, for example, welding the flange portions 51 of the front plate 33 onto the stepped portions 41 of the frame 31 while being engaged with the stepped portions 41.

Where the flange portions 51 of the front plate 33 engage with the stepped portions 41 of the frame 31, the frame 31 and the flange portions 51 form a plane. Accordingly, a gap is not formed between the frame 31 and the rectangular rim 26 (see FIG. 2) of the cooking chamber 20.

As shown in FIG. 5, where the flange portions 51 engage with and are welded onto the stepped portions 41, the top and bottom plates 34 and 35 of the see-through member 32 cover the top and bottom of an inner space formed inside the front plate 33 of the see-through member 32, respectively, and outer edges of the top and bottom plates 34 and 35 come into contact with upper and lower ends of the front plate 33, respectively.

Thereafter, the outer edge of the top plate 34 and the upper end of the front plate 33, and the outer edge of the bottom plate 35 and the lower end of the front plate 33 are, for example, welded together to securely fix the second piece 50 to the first piece 40. Reference numerals 61 and 62 designate a welding line formed between the outer edge of the top plate 34 and the upper end of the front plate 33, and a welding line formed between the outer edge of the bottom plate 35 and the upper end of the front plate 33, respectively.

The first and second pieces 40 and 50 are welded together through, for example, a projection welding process.

Although the first and second pieces 40 and 50 have been described as being welded together through a projection welding process, it is understood that a process of joining the two pieces 40 and 50 is not limited to the projection welding process. For example, the first and second pieces 40 and 50 can be attached together through a caulking process or riveting process. Additionally, although the first and second pieces 40 and 50 have been described as being manufactured through a press working process it is also understood that a manufacturing process of the two pieces 40 and 50 is not limited to the press working process, and other manufacturing processes may be used.

Figure 6:
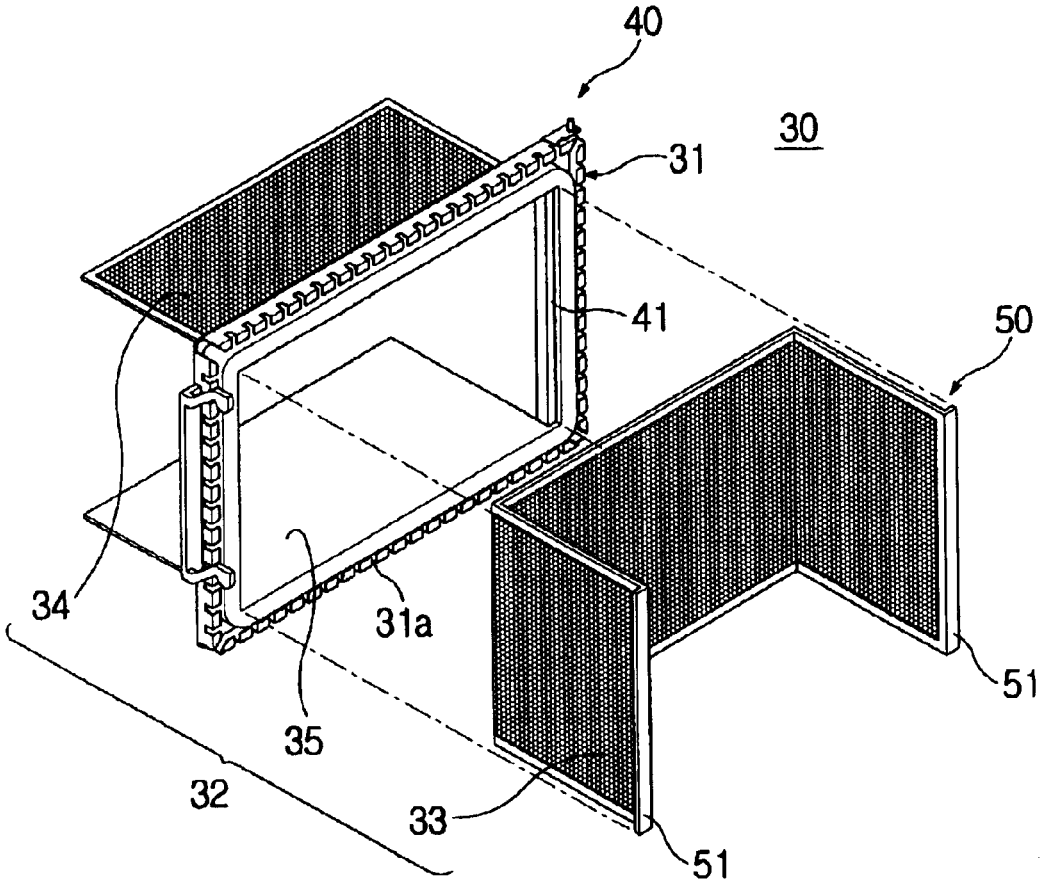
FIG. 6 is an exploded perspective view of a door of a microwave oven according to another embodiment of the present invention.
Figure 7:
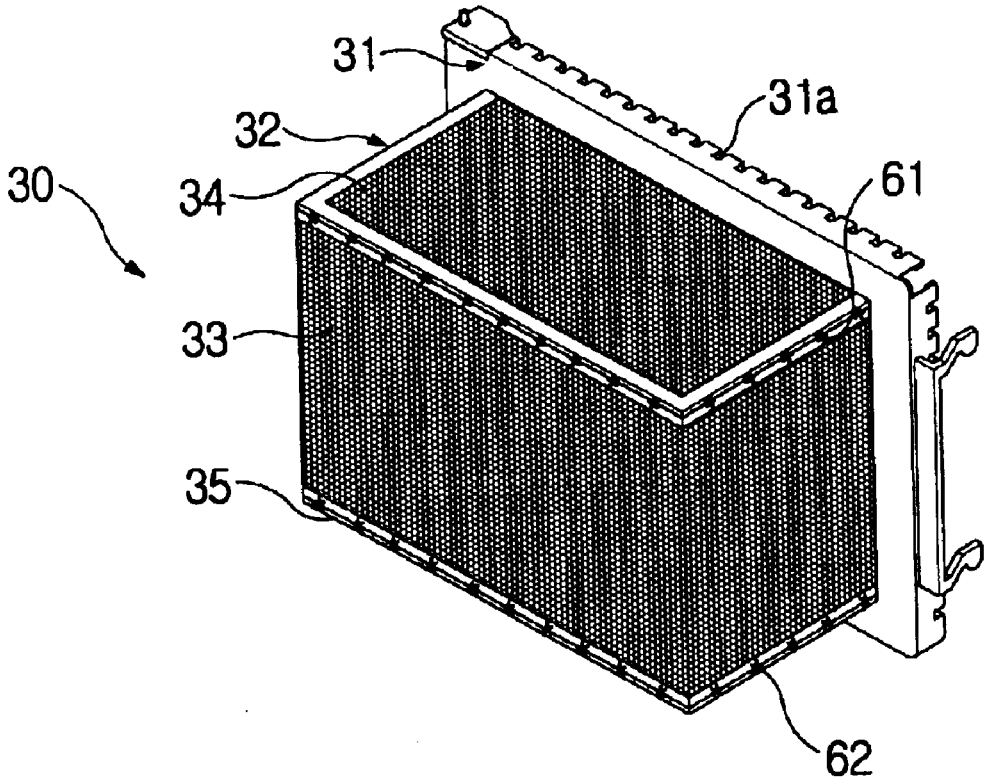
FIG. 7 is a perspective view of the door shown in FIG. 6, as assembled in accordance with the present invention.

FIG. 6 shows an exploded perspective view of a door 30 of a microwave oven according to another embodiment of the present invention. FIG. 7 shows a perspective view of the door 30 shown in FIG. 6, as assembled according to the present invention. As illustrated in these drawings, a see-through member 32 of the door 30 in this embodiment is constructed to project forward in a form of a box. An example of a box-shaped see-through member 32 is shown to illustrate that a see-through member can have other shapes, in addition to a semi-cylindrical shape shown in FIGS. 2 through 4.

Since the door 30 of the FIG. 6 has the same joining structure as that of the door 30 of FIGS. 2 through 4, except for their respective shapes, a further description of the door 30 shown in FIGS. 6 and 7 is omitted to avoid repetition.

As described above, the present invention provides a microwave oven having a door which projects forward so as to provide a visual contact of an interior of a cooking chamber from a variety of viewing locations or angles. Accordingly, a user can ascertain a cooking status of food being cooked in the cooking chamber from various locations outside of the microwave oven.

In addition, a projecting door of the present invention can be manufactured through, for example, a press working process, and joined through, for example, a welding process. Thus, the door can be easily and rapidly manufactured.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven, comprising:

a heating unit to cook food;

a cooking chamber having a vertical front portion and a bottom portion which protrudes outwardly in a horizontal direction; and a door which selectively opens and closes the opening of the cooking chamber, and comprises:

a first piece including a a top plate, a bottom plate and a frame constructed to form an outer edge of the door and to be brought into contact with a rim of the opening, and a second piece including a front plate projected forward from both sides of the frame, wherein the door is formed by joining the first piece with the second piece and the top and bottom plates are attached to respective upper and lower ends of the front plate to form a cooking space extending from the cooking chamber.

2. The microwave oven according to claim 1, wherein:

the front, top and bottom plates are made of metallic plates, and the front and top plates include a plurality of see-through holes.

3. The microwave oven according to claim 1, wherein:

the heating unit includes a magnetron which generates microwaves to cook the food, and the frame includes a plurality of choke slits which prevent a leakage of the microwaves from the cooking chamber through the door, where the opening is closed by the door.

4. The microwave oven according to claim 1, wherein:

the front plate has a half-cylinder shape, and the top and bottom plates are each shaped in a form of a semi-circle to cover a top and a bottom of an inner space formed inside the front plate, respectively.

5. The microwave oven according to claim 1, wherein:

the front plate has a half-box shape with an open top and bottom, and the top and bottom plates are each shaped in a form of a rectangle to cover a top and a bottom of an inner space formed inside the front plate, respectively.

6. The microwave oven according to claim 1, wherein the top and bottom plates are attached to the respective upper and lower ends of the front plate through one of a welding process, a caulking process and a riveting process.

7. The microwave oven according to claim 1, wherein:

the front plate includes flange portions which extend outward from respective side ends of the front plate, and the flange portions are attached to corresponding inner ends of the both sides of the frame.

8. The microwave oven according to claim 7, wherein the flange portions are attached to the frame through one of a welding process, a caulking process and a riveting process.

9. The microwave oven according to claim 8, wherein the frame includes stepped portions which are provided at the inner ends of the both sides of the frame so as to receive the flange portions of the front plate.

10. The microwave oven according to claim 1, wherein the first piece is manufactured by primarily manufacturing a single flat body, into which the frame and the top and bottom plates are integrated, through a press working process, and secondarily bending the top and bottom plates forward at a right angle.

11. The microwave oven according to claim 1, wherein the heating unit includes a magnetron which generates microwaves to cook the food.

12. The microwave oven according to claim 1, wherein the frame and the top and bottom plates are integrally formed as a single structure.

13. The microwave oven according to claim 1, wherein the front and top plates include a plurality of see-through holes.

14. The microwave oven according to claim 13, wherein the front and top plates provide a multiple plane of views into the cooking chamber.

15. The microwave oven according to claim 13, wherein:

the bottom plate includes a plurality of see-through holes, and the front, top and bottom plates provide a multiple plane of views into the cooking chamber.

16. The microwave oven according to claim 13, further comprising a transparent panel which covers the see-through holes of the front plate.

17. A cooking apparatus, comprising:

a heating unit to cook food;

a cooking chamber having a vertical front portion and a bottom portion which protrudes outwardly in a horizontal direction;

a door which selectively opens and closes the opening, and comprises:

a frame constructed to form an outer edge of the door to contact and close the opening and comprising a top plate and a bottom plate, and a front see-through member which is projected forward from the frame and provides a multiple plane of views into a space defined by the cooking chamber and the door closed thereto, wherein the top and bottom plates are attached to respective upper and lower ends of the front see-through member to form a cooking space extending from the cooking chamber, together with the front plate.

18. The cooking apparatus according to claim 17, wherein the top plates and the front see-through member include see-through holes and provide the multiple plane of views into the space.

19. The cooking apparatus according to claim 18, wherein the heating unit includes a magnetron which generates microwaves to cook the food.

* * * * *